US005413818A

United States Patent [19]

Suga et al.

[11] Patent Number: 5,413,818

[45] Date of Patent: May 9, 1995

[54] CURTAIN COATING METHOD AND APPARATUS UTILIZING CHECKING PLATE FOR CONTROLLING LIQUID FLOW

[75] Inventors: Yasushi Suga; Kiyoshi Kobayashi; Toshimitu Sasahara, all of Kanagawa, Japan

[73] Assignee: Fuji Photo Film Co., Ltd., Kanagawa, Japan

[21] Appl. No.: 993,803

[22] Filed: Dec. 15, 1992

Related U.S. Application Data

[63] Continuation of Ser. No. 714,525, Jun. 13, 1991, abandoned.

[30] Foreign Application Priority Data

Jun. 28, 1990 [JP] Japan ..... 2-168275

[51] Int. Cl.[6] ..... B05D 1/30

[52] U.S. Cl. ..... 427/420; 118/324; 118/DIG. 4

[58] Field of Search ..... 427/420; 118/DIG. 4, 118/326, 324

[56] References Cited

U.S. PATENT DOCUMENTS

| | | | |
|---|---|---|---|
| 4,791,004 | 12/1988 | Suzuki et al. | 427/420 |
| 4,922,851 | 5/1990 | Morikawa et al. | 427/420 |
| 4,951,268 | 8/1990 | Kozak | 427/420 |

OTHER PUBLICATIONS

Webster's II New Riverside University Dictionary, 1984, p. 395 (no month date).

*Primary Examiner*—Shrive P. Beck
*Assistant Examiner*—Katherine A. Bareford
*Attorney, Agent, or Firm*—Sughrue, Mion, Zinn, Macpeak & Seas

[57] ABSTRACT

A curtain coating method and apparatus using a rotatable or slidable coating plate and in which a coating liquid freely falls in the form of a thin film from a hopper. The thin film collides with a web continuously running and circumferentially turning around a backup roller to coat the web. The coating plate is rotated or slid to retract so that the freely falling coating liquid reaches the web so as to coat the web after the freely falling coating liquid flows along a checking plate which is doglegged in section and provided on a forward end of the coating plate, thereby coating the web with an even thickness at the start of coating operations.

14 Claims, 2 Drawing Sheets

CURTAIN COATING METHOD AND APPARATUS UTILIZING CHECKING PLATE FOR CONTROLLING LIQUID FLOW

This is a Continuation of application Ser. No. 07/714,525 filed Jun. 13, 1991 now abandoned.

BACKGROUND OF THE INVENTION

1. Field of the Invention

The present invention relates to a method for forming a coating with various kinds of liquid compositions (hereinafter referred to as "a coating liquid") onto a continuously running belt-like support (hereinafter referred to as "a web") used in manufacturing photosensitized material film; photographic print paper; magnetic recording materials such as magnetic recording tapes, etc.; adhesive tape; information recording paper such as pressure-sensitive paper, heat-sensitive paper, etc.; other photographic printing plate, and so on. More particularly, the present invention relates to a curtain coating method and an apparatus therefor.

2. Description of the Related Art

A curtain coating method and an apparatus therefor are representative of a method and apparatus in which a coating liquid in the form of a thin film is made to collide with a running web so as to coat the running web with the coating liquid.

Curtain coating method and apparatus therefor include a method and apparatus wherein a freely falling curtain film composed of one or more kinds of coating liquids is made to collide with an object to be coated so as to form a coating film on the object. The basic curtain coating method and apparatus therefor have been used for many years for coating furniture, iron plates, etc. Recently, however, the curtain coating method has been applied to a field in which accuracy is particularly required, such as in manufacturing photosensitized materials, as disclosed in U.S. Pat. No. 3,632,374 or U.S. Pat. No. 3,508,947.

In such a method and apparatus, it is extremely important to evenly apply the freely falling curtain film at the time coating is started.

Compared with a slide-hopper-type bead coating method, the curtain coating method is required to perform coating at a higher speed. Therefore, the flow of the fed liquid is required to be increased correspondingly. As a result, forming an even coating becomes difficult at the start of coating. In the case where even coating cannot be performed, problems may occur in products because of contamination due to spattering of the coating liquid, contamination of a roller in the stage after a drying zone due to a not-yet-dried thickly-coated portion, or the like.

A curtain coating method is disclosed, for example, in Japanese Patent Publication No. Sho-49-24133, in which a rotatable or slidable device called a deflector (coating plate) is used for dual purposes, namely, for forming a stable curtain film to feed a predetermined quantity of coating at the start of coating and for collecting the coating liquid prior to the start of coating.

FIG. 4 shows the coating method disclosed in U.S. Pat. No. 3,632,374. A coating liquid 13 made to flow onto a slide surface 12 of a slide hopper 11 and then freely falls in the form of a thin film from a forward end portion 14 of the slide surface 12 to form a curtain film 15. The curtain film 15 is made to collide with a running web 16 so as to form a coating thereon. Before coating is started, a rectangular plane coating plate 18 is inserted so as to interrupt the curtain film 15 so that the coating liquid flows along the coating plate 18 so as to be collected in a collecting tank 21. At the start of coating, the coating plate 18 is rotated about a fulcrum 19 so that the curtain film 15 reaches the web 16 to thereby perform coating. Further, the opposite side ends of the curtain film 15 are held by edge guides 20 extending from the forward end portion 14 of the slide surface 12 to a position lower than the position at which the curtain film 15 collides with the web.

This method has an effect that, in the case of single layer coating, the free falling curtain film 15 is received by the coating plate 18 prior to the start of coating so that the coating liquid can be collected in the collecting tank 21 so as to be used again. However, the apparatus has the following three defects. The first defect is that the curtain film 15 is required to be sufficiently high in order to rotate or slide the coating plate 18 and, therefore, the use of the apparatus is limited in the case where there is not sufficient space. The second defect is that non-coating portions exist at the opposite side ends of the curtain film 15 between the edge guides 20 and the coating plate 18. The third defect is that although the coating liquid is applied onto the entire width of the web 16 at the same time, at the instance when the rotating and retreating coating plate 18 is separated from the curtain film 15 at the start of coating a thickly coated portion is formed with the coating liquid lump portion.

U.S. Pat. No. 4,922,851 and U.S. Pat. No. 4,851,268 disclose a coating apparatus which attempts to overcome the above-mentioned defects. Namely, the coating plate is caused to effectively function to realize smooth coating, that is, coating without the formation of thick portions, even in the case where film formation is difficult in the slide-hopper-type curtain coating apparatus. In this apparatus, an L-shaped coating plate 9 as shown in FIGS. 3(*a*) and 3(*b*) is used in a manner so that the sliding speed of the coating plate 9 can be suitably selected.

However, in the method and apparatus disclosed in the above U.S. Pat. No. 4,922,851 and U.S. Pat. No. 4,851,268, when the coating plate 9 is removed, a freely falling coating-liquid film 5 wets the lower surface of a forward end portion of the coating plate 9 as shown in FIG. 3(*a*) so that the liquid is finally moved onto the web 6 together with the liquid to be applied onto the web 6 so as to form an excessive bead portion 22 as shown in FIG. 3(*b*), and a part of the bead portion 22 becomes a thickly coated portion at the start of coating, while another part swings so as to make the bead unstable, resulting in unevenness in the coated film thickness. Assume that a point where the freely falling coating-liquid film 5 falls down onto the web 6 is a coating point and that an angle (hereinafter referred to as "coating angle") between a vertical line and a straight line starting from the center of rotation of a backup roller to the coating point is $\Psi$, coating has been difficult particularly in the case where the coating angle $\Psi$ is larger than 30 degrees in the conventional method and apparatus.

SUMMARY OF THE INVENTION

It is an object of the present invention to provide a coating method and an apparatus in which the above problems in the prior art are solved, and in which thick coating can be prevented at the start of coating, coating can be made easy in the case where the coating angle $\Psi$ is larger than 30 degrees, and even coating can be performed.

The above and other objects of the present invention have been achieved by a coating method in which a rotatable or slidable coating plate is prepared and a coating liquid freely falling in the form of a thin film from a hopper is made to collide with a web continuously running and circumferentially turning around a backup roller to thereby perform coating, the curtain coating method being characterized in that the coating plate having a checking plate doglegged in section and provided on a forward end of the coating plate is inserted so that the freely falling coating liquid flows along the checking plate before the freely falling coating liquid reaches the web so as to be coated on the web.

The curtain coating method is further characterized in that the coating plate is placed so that an elevation angle $\delta$ of the coating plate is 10–60 degrees from a horizontal line, an angle $\Phi$ between a vertical line and an upper width $w_1$ of the coating plate is 10–60 degrees, and an angle $\xi$ between the vertical line and a lower width $w_2$ is 0–60 degrees when the freely falling coating liquid is made to flow along the checking plate doglegged in section and provided on the forward end of the coating plate the vertical line being perpendicular to the horizontal line.

The above objects of the present invention are also achieved by a coating apparatus in which a rotatable or slidable coating plate is provided and a coating liquid freely falling in the form of a thin film from a hopper is made to collide with a web and circumferentially turning around a backup roller to thereby perform coating, the curtain coating apparatus being characterized in that the coating plate is provided at its forward end with a checking plate doglegged in section.

The curtain coating apparatus is further characterized in that upper and lower widths $w_1$ and $w_2$ of the checking plate doglegged in section and provided on the forward end of the coating plate are 2–10 mm and 1–5 mm, respectively, and in that the curtain coating apparatus is provided with means for rotating or sliding the coating plate so that an elevation angle $\delta$ of the coating plate is 10–60 degrees from a horizontal line, an angle $\Phi$ between a vertical line and an upper width $w_1$ of the coating plate is 10–60 degrees, and an angle $\xi$ between the vertical line and a lower width $w_2$ is 0–60 degrees when the freely falling curtain film passes just above the checking plate, the vertical line being perpendicular to the horizontal line.

BRIEF DESCRIPTION OF THE DRAWINGS

The invention will be more clearly understood from the following description in conjunction with the accompanying drawings, wherein:

FIG. 1(*b*) is a side view of a coating plate according to the present invention;

DETAILED DESCRIPTION OF THE PREFERRED EMBODIMENT

Figure 1A:
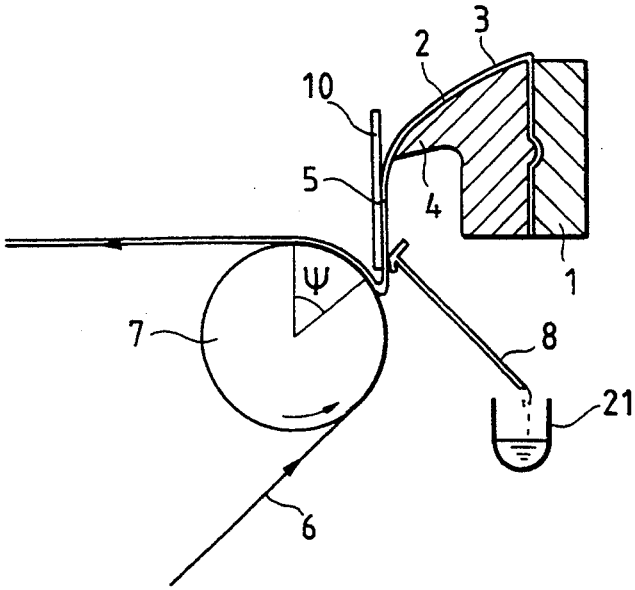
FIG. 1(*a*) is a schematic side sectional view for explaining an embodiment of the coating method and apparatus according to the present invention.
Figure 1B:
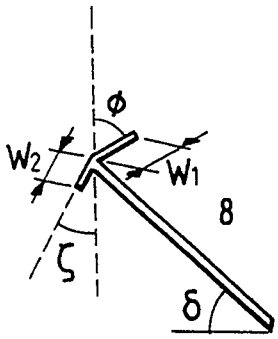

Referring to FIGS. 1(*a*) and 1(*b*), a preferred embodiment of the present invention will be described in detail below.

A coating liquid 3 made to flow onto a slide surface 2 of a slide hopper 1 freely falls in the form of a thin film from a forward end portion 4 of the slide surface 2 to form a curtain film 5. The curtain film 5 is made to collide with a web 6 continuously running and circumferentially turning around a backup roller 7 to thereby perform coating.

Before coating, a rectangular plane coating plate 8 is inserted at an elevation angle $\delta$ so as to interrupt the curtain film 5 so that the coating liquid 3 is made to flow along the coating plate 8 so as to be gathered in a collecting tank 21.

Figure 2A:
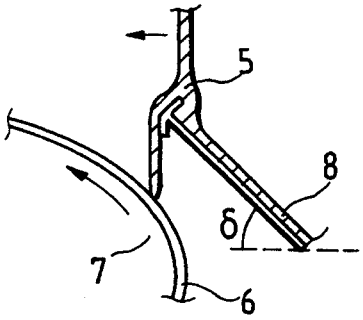
FIGS. 2(*a*) and 2(*b*) are partial side views for explaining the bead production state in the coating according to the present invention.
Figure 2B:
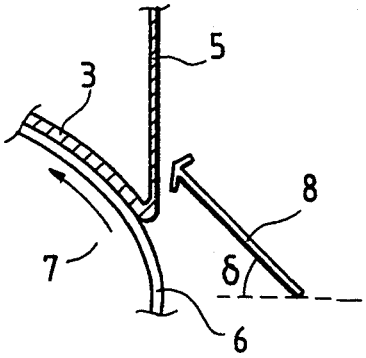

At the start of coating, the slide hopper 1 is moved toward the backup roller 7 while the coating plate 8 remains in the inserted portion and a t the elevation angle $\delta$. This state is shown in FIG. 2(*a*). In the embodiment, since the freely falling curtain film 5 is made to flow along a doglegged checking plate at a forward end of the coating plate 8 so that the curtain film 5 reaches a position of the web 6 to be coated without rounding the end of the coating plate 8, and the quantity of liquid consumed at the start of coating is kept to a minimum. Accordingly, as shown in FIG. 2(*b*), the bead of the curtain film 5 quickly becomes stable so that it is made possible to perform coating without forming a thick portion.

It is also possible as a modification of the embodiment shown above that the coating plate 8 is rotated or slide to retract at the start of coating while the hopper remains in the portion at which coating is to be performed.

FIG. 1(*b*) is a side view showing in detail the coating plate 8 according to the present invention.

The elevation angle $\delta$ of the coating plate 8 is 10–60 degrees from a horizontal line, the upper width $w_1$ of the doglegged checking plate provided on the forward end of the coating plate is 2–10 mm, the angle $\Phi$ between the upper width $w_1$ and a vertical line perpendicular to the horizontal line is 10–60 degrees, the lower width $w_2$ of the doglegged checking plate is 1–5 mm, and the angle $\xi$ between the lower width $w_2$ and a vertical line is 0–60 degrees. Though not shown, the coating apparatus includes means for rotating or sliding the coating plate 8 so as to retract the coating plate 8 after the start of coating.

The material of which in the checking plate is made can be an ordinary metal material or synthetic resin, preferably a metal coated with a water repellent resin.

The coating liquids used in the present invention include various kinds of liquid compositions depending on the application at hand. For example, liquid compositions suitable for use with the invention include coating liquids for a photographic emulsion layer, an undercoating layer, a protective layer, a backing layer, and so on in a photosensitized material; coating liquids for a magnetic layer, undercoating layers, a lubricating layer, a protecting layer, a back layer, and so on in a magnetic recording material; coating liquids for a layer having micro-capsules as a main component, a layer having a developer as a main component, and so on in information recording paper; and coating liquids for a photosensitive layer, a resin layer, a mat layer, and so on in a photographic plate-making material.

The web 6 used with the invention can, for example, be paper, plastic film metal, resin-coated paper, synthetic paper, and so on. Examples of the material of the plastic film are polyolefins such as polyethylene, polystyrene, or the like; a vinyl polymer such as poly(vinyl acetate), poly(vinyl chloride), or the like; polyamides such as 6, 6-nylon, 6-nylon, or the like; polyesters such as polyethylene-telephthalate, polyethylene-2, 6-naphthalate, or the like; polycarbonate; and cellulose acetates such as cellulose triacetate, cellulose diacetate, or the like, etc. An example of the resin to be used for the resin-coated paper, is polyolefin such as polyethylene, but it is not limited to this particular example. Further, an example of the metal web is an aluminum web.

Although curtain coating using a slide-hopper-type hopper is mentioned in the above description of the present invention, the hopper is not limited to a slide-hopper type hopper, but it is a matter of course that the present invention is also applicable to an extrusion-type hopper.

In order to make the effects of the present invention more clear, examples of the invention will be described below.

Coating was performed by using a apparatus constructed according to the present invention as shown in FIG. 1. A liquid obtained by thickening a 5% aqueous solution of an alkali-treated gelatin including 0.125 weight % of anion-group surface-active agent dodecyl benzene sodium sulfonate by polystyrene sodium sulfonate to 30 cps and 70 cps at a shearing rate of 10 $sec^{-1}$ was used as the coating liquid under the following conditions.

Quantity of coating: 80 $cc/m^2$

Elevation angle of coating plate: $\delta=30°$

The other conditions were as indicated in Table 1.

Figure 3A:
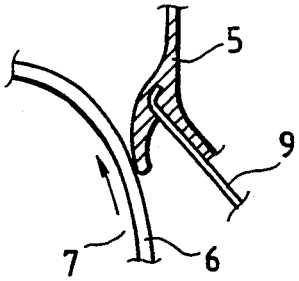
FIG. 3(a) PRIOR ART
FIGS. 3(*a*) and 3(*b*) are partial side views for explaining the bead production state at the start of coating in the case where a conventional coating plate is used.
Figure 3B:
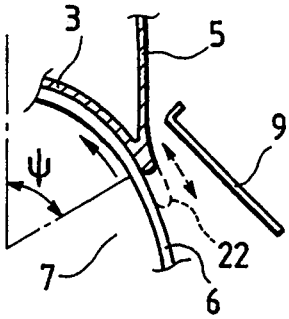
FIG. 3(b) PRIOR ART
Figure 4:
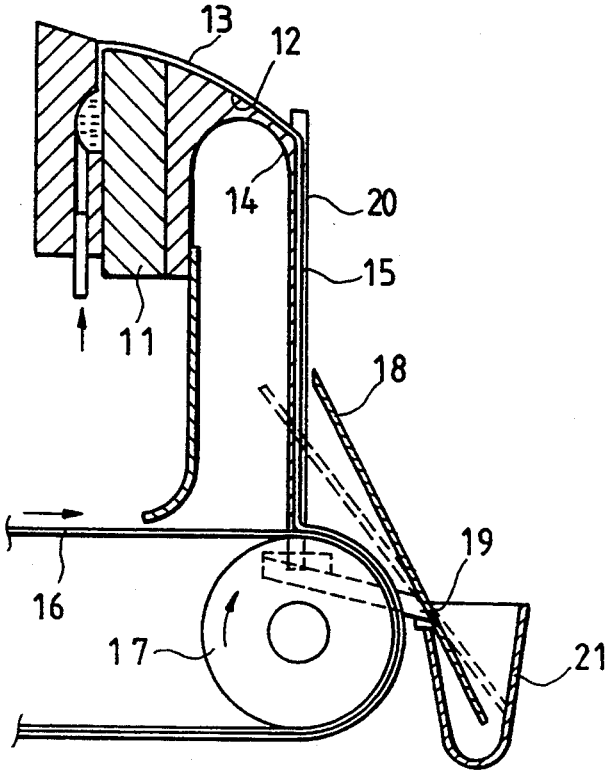
FIG. 4 PRIOR ART
FIG. 4 is a side view of an example according to a conventional technique.

At the same time, as comparative examples, coating was performed using an L-shaped coating plate as shown in FIGS. 3(*a*) and 3(*b*), the other conditions being the same as those of the above examples of the present invention. The results of the comparison between the examples and the comparative examples are shown in Table 1.

TABLE 1

| | Coating speed (m/min) | Coating angle (°) | Coating liquid viscosity (cp) | Shape of checking plate | State of coating surface |
|---|---|---|---|---|---|
| Examples | 200 | 50 | 30 | Doglegged shaped | Even; Thick coating good |
| | 300 | 50 | 30 | Doglegged shaped | Even; Thick coating good |
| | 300 | 50 | 70 | Doglegged shaped | Even; Thick coating good |
| Comparative Examples | 200 | 50 | 30 | L-shaped | Coating impossible |
| | 300 | 50 | 30 | L-shaped | Uneven; Foams |
| | 300 | 15 | 70 | L-shaped | Even; Thick coating good |
| | 300 | 15 | 60 | L-shaped | Even; Thick coating good |

From the above results, it is found that the state of the coated surface was even without any thick portions in the examples of the present invention, even at a coating angle of 50 degrees at which the state of the coated surface becomes uneven or coating per se becomes impossible in the comparative examples.

In the coating method and apparatus therefor according to the present invention, thick coating can be prevented from occurring at the start of curtain coating, and particularly it becomes possible to perform coating even in the case where the coating angle $\delta$ is larger than30 degrees, so that the present invention contributes to raising the coating rate and improving the coating quality.

Many features and advantages of the invention are apparent from the detailed specification, and thus it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described, accordingly all suitable modifications and equivalents may be resorted to as falling within the scope of the invention.

What is claimed is:

1. In a curtain coating method in which a coating liquid freely falling in the form of a film from a hopper is made to collide with a web, along a collision line, continuously running and circumferentially turning around a backup roller to thereby perform coating utilizing a coating plate, the improvement wherein said coating plate has a checking plate which is doglegged in section provided on a forward end of said coating plate and is inserted so that said freely falling coating liquid flows along said checking plate before said freely falling coating liquid reaches said web so as to be coated on said web, said checking plate comprising first and second projections extending from an end of said coating plate, said first projection extending above an extended line defined by said coating plate and said second projection extending below said extended line.

2. A curtain coating method as recited in claim 1, further characterized in that said coating plate is placed so that an elevation angle $\delta$ of said coating plate is 10–60 degrees from a horizontal line, an angle $\Phi$ between a vertical line and said first projection is in a range of 10–60 degrees, and an angle $\xi$ between said vertical line and said second projection is in a range of 0–60 degrees when said freely falling coating liquid flows along said checking plate, said vertical line being perpendicular to said horizontal line and being parallel to a direction in which said freely falling liquid falls.

3. A curtain coating method as recited in claim 1, further characterized in that said coating plate is placed so that an angle $\Phi$ between a vertical line and said first projection is in a range of 10–60 degrees, and an angle $\xi$ between said vertical line and said second projection is in a range of 0–60 degrees when said freely falling coating liquid flows along said checking plate, wherein said freely falling coating liquid falls in a direction parallel to said vertical line.

4. In a coating apparatus in which a coating liquid freely falling in the form of a film from a hopper is made to collide with a web continuously running and circumferentially turning around a backup roller to thereby perform coating utilizing a coating plate, the improvement wherein said coating plate is provided at its forward end with a checking plate which is doglegged in section, said checking plate comprising first and second projections extending from an end of said coating plate, said first projection extending above an extended line defined by said coating plate and said second projection extending below said extended line.

5. A curtain coating apparatus as recited in claim 4, further characterized in that said first and second projections of said checking plate are provided on the forward end of said coating plate and are in a range of 2–10 mm and 1–5 mm, respectively, and in that said curtain coating apparatus is further provided with means for rotating or sliding said coating plate so that an elevation angle $\delta$ of said coating plate is 10–60 degrees from a horizontal line, an angle $\Phi$ between a vertical line and said first projection is in a range of 10–60 degrees, and an angle $\xi$ between said vertical line and said second projection is in a range of 0–60 degrees when said hopper passes just above said checking plate, said vertical line being perpendicular to said horizontal line and being parallel to a direction in which said freely falling liquid falls.

6. A curtain coating apparatus as recited in claim 4, wherein a coating angle between a vertical line extending upward from the center of rotation of said backup roller and a straight line from the center of rotation of said backup roller to a center of said collision line is greater than 30°.

7. A curtain coating apparatus as recited in claim 4, further characterized in that said first and second projections of said checking plate are provided on the forward end of said coating plate and are in a range of 2–10 mm and 1–5 mm, respectively, and in that said curtain coating apparatus is further provided with means for rotating or sliding said coating plate so that an angle $\Phi$ between a vertical line and said first projection is in a range of 10–60 degrees, and an angle $\xi$ between said vertical line and said second projection is in a range of 0–60 degrees when said hopper passes just above said checking plate, wherein said freely falling coating liquid falls in a direction parallel to said vertical line.

8. A curtain coating apparatus for performing a coating operation to coat a web, said apparatus comprising:

means for supplying a free-falling curtain film of a coating liquid, said curtain film falling towards the web to coat the web with the curtain film; and means for interrupting the falling of the curtain film toward the web and for altering the flow of the curtain film to produce a coating with an even thickness during the start of coating operations, said means for interrupting comprising a coating plate having first and second projections formed on an end thereof, said first projection extending above an extended line defined by said coating plate and said second projection extending below said extended line.

9. A curtain coating apparatus as recited in claim 8, wherein the curtain film comprises a plurality of coating liquids.

10. A curtain coating apparatus as recited in claim 8, wherein said first and second projections of said coating plate form a doglegged forward end, the doglegged forward end altering the flow of the curtain film to produce a coating with an even thickness during the start of coating operations.

11. A curtain coating apparatus as recited in claim 10, wherein said coating plate means is rotatably mounted.

12. A curtain coating apparatus as recited in claim 10, wherein said coating plate means is slidably mounted.

13. In a coating apparatus in which a coating liquid freely falling in the form of a film from a hopper is made to impinge on a web, along a line, said web continuously running around a backup roller to thereby coat the web utilizing a coating plate, the improvement wherein said coating plate has a doglegged checking plate disposed on a forward end thereof, said checking plate comprising first and second projections extending from an end of said coating plate, said first projection extending above an extended line defined by said coating plate and said second projection extending below said extended line, a coating angle between a vertical line which extends upward from the center of rotation of said backup roller and a straight line extending from the center of rotation of said backup roller to a point on said line is greater than 30 degrees, said coating liquid falls in a direction which is substantially parallel to said vertical line.

14. In a coating apparatus in which a coating liquid freely falling in the form of a film from a hopper is made to collide, along a collision line, with a web continuously running and circumferentially turning around a backup roller to thereby perform coating utilizing a coating plate, the improvement wherein said coating plate is provided at its forward end with a checking plate which is doglegged in section, said checking plate comprising first and second projections extending from an end of said coating plate said first projection extending above an extended line defined by said coating plate and said second projection extending below said extended line;

a coating angle between a vertical line extending upwards from the center of rotation of said backup roller and a straight line extending from the center of rotation of said backup roller to a center of said collision line being greater than 30°.

* * * * *